US007713470B2

(12) United States Patent
Toyoda et al.

(10) Patent No.: US 7,713,470 B2
(45) Date of Patent: May 11, 2010

(54) DIE CASTING HAVING HIGH TOUGHNESS

(75) Inventors: Yusuke Toyoda, Wako (JP); Takahiro Mizukami, Wako (JP); Fumiaki Fukuchi, Wako (JP); Tsunehisa Hata, Wako (JP); Katsuhiro Shibata, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 683 days.

(21) Appl. No.: 10/518,151

(22) PCT Filed: May 14, 2003

(86) PCT No.: PCT/JP03/05993

§ 371 (c)(1),
(2), (4) Date: Sep. 27, 2005

(87) PCT Pub. No.: WO03/102257

PCT Pub. Date: Dec. 11, 2003

(65) Prior Publication Data

US 2006/0137848 A1 Jun. 29, 2006

(30) Foreign Application Priority Data

May 30, 2002 (JP) ..... 2002-157328
May 30, 2002 (JP) ..... 2002-157329

(51) Int. Cl.
*C22C 21/06* (2006.01)
*B22D 21/04* (2006.01)

(52) U.S. Cl. ..... 420/543; 148/440; 148/415

(58) Field of Classification Search ..... 420/542, 420/543, 544, 546, 547, 552, 553; 148/415–417, 148/437–440, 549, 552, 523
See application file for complete search history.

(56) References Cited

U.S. PATENT DOCUMENTS

| | | | | |
|---|---|---|---|---|
| 1,932,843 | A * | 10/1933 | Dean et al. | 420/543 |
| 4,121,926 | A * | 10/1978 | Ogawa et al. | 420/548 |
| 4,847,048 | A * | 7/1989 | Nishi et al. | 420/547 |
| 5,181,969 | A * | 1/1993 | Komatsubara et al. | 148/552 |
| 6,277,217 | B1 * | 8/2001 | Yoshino et al. | 148/440 |
| 2001/0050118 | A1 * | 12/2001 | Raynaud et al. | 148/439 |
| 2002/0006352 | A1 * | 1/2002 | Spanjers et al. | 420/544 |
| 2002/0088512 | A1 * | 7/2002 | Kitaoka et al. | 148/549 |
| 2002/0134470 | A1 * | 9/2002 | Bradley et al. | 148/516 |
| 2002/0141896 | A1 * | 10/2002 | Komazaki et al. | 420/547 |

(Continued)

FOREIGN PATENT DOCUMENTS

DE EP 918095 * 5/1999

(Continued)

*Primary Examiner*—George Wyszomierski
*Assistant Examiner*—Mark L Shevin
(74) *Attorney, Agent, or Firm*—Hamre, Schumann, Mueller & Larson, P.C.

(57) ABSTRACT

A thin and large high toughness die-cast product is provided that is formed from an Al—Mg casting alloy having the composition 3.5 wt %≦Mg≦4.5 wt %, 0.8 wt %≦Mn≦1.5 wt %, Si<0.5 wt %, Fe<0.5 wt %, a sum (Ti+Zr) of amounts of Ti and Zr added of equal to or greater than 0.3 wt %, and a ratio (Ti/Zr) of the amounts of Ti and Zr added of at least 0.3 but not more than 2, with the balance being Al.

3 Claims, 4 Drawing Sheets

U.S. PATENT DOCUMENTS

2003/0219618 A1 * 11/2003 Toyoda et al. ..... 428/598

FOREIGN PATENT DOCUMENTS

| | | | |
|---|---|---|---|
| DE | EP 0918915 | * | 5/1999 |
| EP | 0 918 095 | | 5/1999 |
| EP | 1 138 794 | | 10/2001 |
| JP | 01-068440 | * | 3/1986 |
| JP | 64-68440 | | 3/1989 |
| JP | 6-330202 | | 11/1994 |
| JP | 0 892 077 | | 1/1999 |
| JP | 11-293375 | | 10/1999 |

* cited by examiner

DIE CASTING HAVING HIGH TOUGHNESS

FIELD OF THE INVENTION

The present invention relates to a high toughness die-cast product.

BACKGROUND ART

With regard to a casting material for a thin and large die-cast product that is required to have high toughness, such as, for example, an automobile door panel, an Al—Mg alloy having excellent toughness is known. In this case, in order to make crystal grains finer and improve the toughness, the use of an Al—Mg alloy to which at least one of Ti and Zr has been added is known.

When casting a thin and large die-cast product, from the viewpoint of maintaining the flowability of the melt, it is desirable for the pouring temperature (liquidus temperature+superheat temperature) to be high, but in the case of an Al—Mg alloy composition melt, when a high pouring temperature is set, there are the problems that the concentration of Mg in the melt greatly decreases due to oxidation of Mg, etc., and soldering of the melt to a die easily occurs. Because of this, the pouring temperature T is set at, for example, 720° C.≦T≦730° C.

In order to make the crystal grains finer by the addition of Ti and Zr, adding large amounts thereof is effective, but if the amounts are increased with no clear purpose, Ti, etc. becomes saturated at the above-mentioned pouring temperature, thus causing the deposition of crystals such as $Al_3Ti$ or $Al_3Zr$.

When increasing the toughness of a die-cast product, there is a limit to the toughness that can be achieved merely by selecting the casting material, and it is impossible to obtain a toughness-improving effect that exceeds this limit.

DISCLOSURE OF INVENTION

It is an object of the present invention to provide a die-cast product having yet further improved toughness, in particular by the use of an Al—Mg casting alloy having a specified sum (Ti+Zr) of amounts of Ti and Zr added and a specified ratio (Ti/Zr) of the amounts of Ti and Zr added.

In order to attain this object, in accordance with the present invention, there is provided a high toughness die-cast product formed from an Al—Mg casting alloy having 3.5 wt %≦Mg≦4.5 wt %, 0.8 wt %≦Mn≦1.5 wt %, Si<0.5 wt %, Fe<0.5 wt %, a sum (Ti+Zr) of amounts of Ti and Zr added of equal to or greater than 0.3 wt %, and a ratio (Ti/Zr) of the amounts of Ti and Zr added of at least 0.3 but not more than 2, with the balance being Al.

When the sum (Ti+Zr) of the amounts of Ti and Zr added and the ratio (Ti/Zr) of the amounts of Ti and Zr added are specified as described above, it is possible to increase the toughness of the Al—Mg alloy, and thus the die-cast product, by making the total amount of Ti and Zr contribute to the formation of fine crystals at the above-mentioned pouring temperature, and it is also possible to avoid problems such as the deposition of crystals.

The reasons for adding each chemical component and for limiting the amount thereof added are as follows.

Mg: Mg contributes to an improvement in the strength and toughness of a die-cast product. When Mg<3.5 wt %, the flowability of the melt is degraded, and when Mg>4.5 wt %, the toughness of the die-cast product is degraded; furthermore, an Al—Mg eutectic intermetallic compound segregates in areas where solidification is delayed, thus causing casting cracks.

Mn: The Fe content of this alloy is set low in order to ensure the toughness of the die-cast product, and since it has a relatively high melting point soldering to a die easily occurs. Mn contributes to an improvement in the soldering resistance and is indispensable for high speed filling casting of a thin and large die-cast product. Mn also improves the strength. When Mn<0.8 wt %, the soldering resistance of the alloy is degraded, and when Mn>1.5 wt %, although the strength of the die-cast product improves, the toughness is degraded, and the flowability of the melt also deteriorates.

Si: Si contributes to an improvement in the strength of the die-cast product, but when Si≧0.5 wt %, since the amount of an $Mg_2Si$ intermetallic compound increases, the toughness of the die-cast product is degraded.

Fe: Fe contributes to an improvement in the strength of the die-cast product, but when Fe≧0.5 wt %, since Fe-based crystals are formed, the toughness of the die-cast product is degraded.

Ti and Zr: Ti and Zr contribute to an improvement in the toughness, the prevention of casting cracks, and an improvement in the flowability of the melt by making the crystal grains of the die-cast product finer. When Ti+Zr<0.3 wt %, the effect of improving the toughness of the die-cast product is insufficient. When Ti/Zr<0.3 or Ti/Zr>2, the toughness of the die-cast product deteriorates.

It is an object of the present invention to provide a thin die-cast product having high toughness achieved by the combined use of selection of a casting material and chilling by a die-casting method.

In order to attain this object, in accordance with the present invention, there is provided a high toughness die-cast product in thin sheet form with a minimum thickness $t_1$ of 1.2 mm≦$t_1$≦3 mm, the high toughness die-cast product being cast using an Al—Mg alloy by a die-casting method, having chill layers on opposite faces thereof, and having a proportion P of the sum of thicknesses $t_3$ and $t_4$ of the two chill layers relative to the minimum thickness $t_1$ set at 18% or greater, and the Al—Mg alloy having 3.5 wt %≦Mg≦4.5 wt %, 0.8 wt %≦Mn≦1.5 wt %, Si<0.5 wt %, Fe<0.5 wt %, and 0.1 wt %≦at least one of Ti and Zr≦0.3 wt %, with the balance being Al.

In accordance with this arrangement, the thin die-cast product is formed from an Al—Mg alloy having good toughness, the cross-sectional structure thereof is a sandwich structure in which a relatively coarse metal structure as a main body is sandwiched between two chill layers having a relatively thick and compact metal structure with, moreover, a lot of the impurities in the melt being captured in the two chill layers, and it is therefore possible to increase the elongation δ of the thin die-cast product having the thickness $t_1$ so that δ≧15%, thereby achieving high toughness. When the proportion P is less than 18%, the elongation δ is less than 15%. In order to increase the thickness of the chill layers, it is necessary to fill a low temperature die with the melt at high speed and increase the speed at which the surface of the die-cast product is cooled by die cooling, but if this technique is applied to a thin die-cast product it easily degrades the casting quality by causing, for example, misruns. In order to improve the elongation of the thin die-cast product without causing such a problem, the upper limit value for the proportion P is set at 60% to 70%.

With regard to the Al—Mg alloy, the reasons for adding each chemical component and for limiting the amount thereof are as follows.

Mg: Mg contributes to an improvement in the strength and toughness of a die-cast product. When Mg<3.5 wt %, the flowability of the melt is degraded, and when Mg>4.5 wt %, the toughness of the die-cast product is degraded; furthermore, an Al—Mg eutectic intermetallic compound segregates in areas where solidification is delayed, thus casting cracks.

Mn: The Fe content of this alloy is set low in order to ensure the toughness of the die-cast product, and since it has a relatively high melting point soldering to a die easily occurs. Mn contributes to an improvement in the soldering resistance and is indispensable for high speed filling casting of a thin and large die-cast product. Mn also improves the strength. When Mn<0.8 wt %, the soldering resistance of the alloy is degraded, and when Mn>1.5 wt %, although the strength of the die-cast product improves, the toughness is degraded, and the flowability of the melt also deteriorates.

Si: Si contributes to an improvement in the strength of the die-cast product, but when Si≧0.5 wt %, since the proportion of an $Mg_2Si$ intermetallic compound increases, the toughness of the die-cast product is degraded.

Fe: Fe contributes to an improvement in the strength of the die-cast product, but when Fe≧0.5 wt %, since Fe-based crystals are formed, the toughness of the die-cast product is degraded.

Ti and Zr: Ti and Zr contribute to an improvement in the toughness, the prevention of casting cracks, and an improvement in the flowability of the melt by making the metal structure of the die-cast product finer. When at least one of Ti and Zr, that is, Ti and/or Zr, is less than 0.1 wt %, since the effect of making the metal structure finer is insufficient, the flowability of the melt deteriorates, and when Ti and/or Zr is greater than 0.3 wt %, the flowability of the melt is degraded due to the appearance of Ti—Al-based high temperature crystals.

BEST MODE FOR CARRYING OUT THE INVENTION

Embodiment I

Table 1 shows the compositions of Examples 1 to 13 of Al—Mg casting alloys. In Examples 1 to 13, among the elements added, the amounts of Mg, Mn, Si, and Fe added were fixed, and the amounts of Ti and Zr added were changed.

TABLE 1

| | Chemical component (wt %) | | | | | | |
|---|---|---|---|---|---|---|---|
| Al—Mg alloy | Mg | Mn | Si | Fe | Ti | Zr | Al |
| Example 1 | 4 | 1 | 0.2 | 0.2 | 0 | 0 | balance |
| Example 2 | | | | | 0.033 | 0.067 | |
| Example 3 | | | | | 0.05 | 0.05 | |
| Example 4 | | | | | 0.066 | 0.134 | |
| Example 5 | | | | | 0.1 | 0.1 | |
| Example 6 | | | | | 0.05 | 0.25 | |
| Example 7 | | | | | 0.075 | 0.225 | |

TABLE 1-continued

| | Chemical component (wt %) | | | | | | |
|---|---|---|---|---|---|---|---|
| Al—Mg alloy | Mg | Mn | Si | Fe | Ti | Zr | Al |
| Example 8 | | | | | 0.1 | 0.2 | |
| Example 9 | | | | | 0.15 | 0.15 | |
| Example 10 | | | | | 0.2 | 0.1 | |
| Example 11 | | | | | 0.225 | 0.075 | |
| Example 12 | | | | | 0.165 | 0.335 | |
| Example 13 | | | | | 0.25 | 0.25 | |

Casting was carried out using melts having the compositions of Examples 1 to 13 by placing a die in a vacuum die-casting machine in which the conditions were: vacuum level within cavity: 6 kPa, die temperature: 200° C., ceramic heat-insulating sleeve temperature: 200° C., pouring temperature: 720° C., low speed injection: 0.5 m/sec, and high speed injection: 3 m/sec (converted to gate speed: 40 m/sec), and thin and large die-cast products of Examples 1 to 13 having an overall thickness of 2 mm (this was also the minimum thickness), a length of about 300 mm, and a width of about 100 mm were produced. In this case, a maximum flow distance d of the melt within the die cavity was approximately 300 mm. These Examples 1 to 13 correspond to Examples 1 to 13 of the Al—Mg alloy. Test pieces were prepared using each of the die-cast products of Examples 1 to 13, and these test pieces were subjected to measurement of α phase average particle size, elongation, and tensile strength. Table 2 shows the sum (Ti+Zr) of the amounts of Ti and Zr added, the ratio Ti/Zr of the amounts of Ti and Zr added, the α phase average particle size, the elongation, and the tensile strength of Examples 1 to 13.

TABLE 2

| Die-cast product | Ti + Zr (wt %) | Ti/Zr | α Phase average particle size (μm) | Elongation (%) | Tensile strength (MPa) |
|---|---|---|---|---|---|
| Example 1 | — | — | 19 | 12 | 255 |
| Example 2 | 0.1 | 0.5 | 12 | 16 | 278 |
| Example 3 | 0.1 | 1 | 13 | 15 | 279 |
| Example 4 | 0.2 | 0.5 | 8 | 19 | 282 |
| Example 5 | 0.2 | 1 | 10 | 17 | 281 |
| Example 6 | 0.3 | 0.2 | 9 | 16 | 277 |
| Example 7 | 0.3 | 0.3 | 5 | 22 | 284 |
| Example 8 | 0.3 | 0.5 | 5 | 24 | 285 |
| Example 9 | 0.3 | 1 | 7 | 21 | 283 |
| Example 10 | 0.3 | 2 | 7 | 20 | 284 |
| Example 11 | 0.3 | 3 | 11 | 16 | 280 |
| Example 12 | 0.5 | 0.5 | 4 | 26 | 287 |
| Example 13 | 0.5 | 1 | 6 | 22 | 285 |

Figure 1:
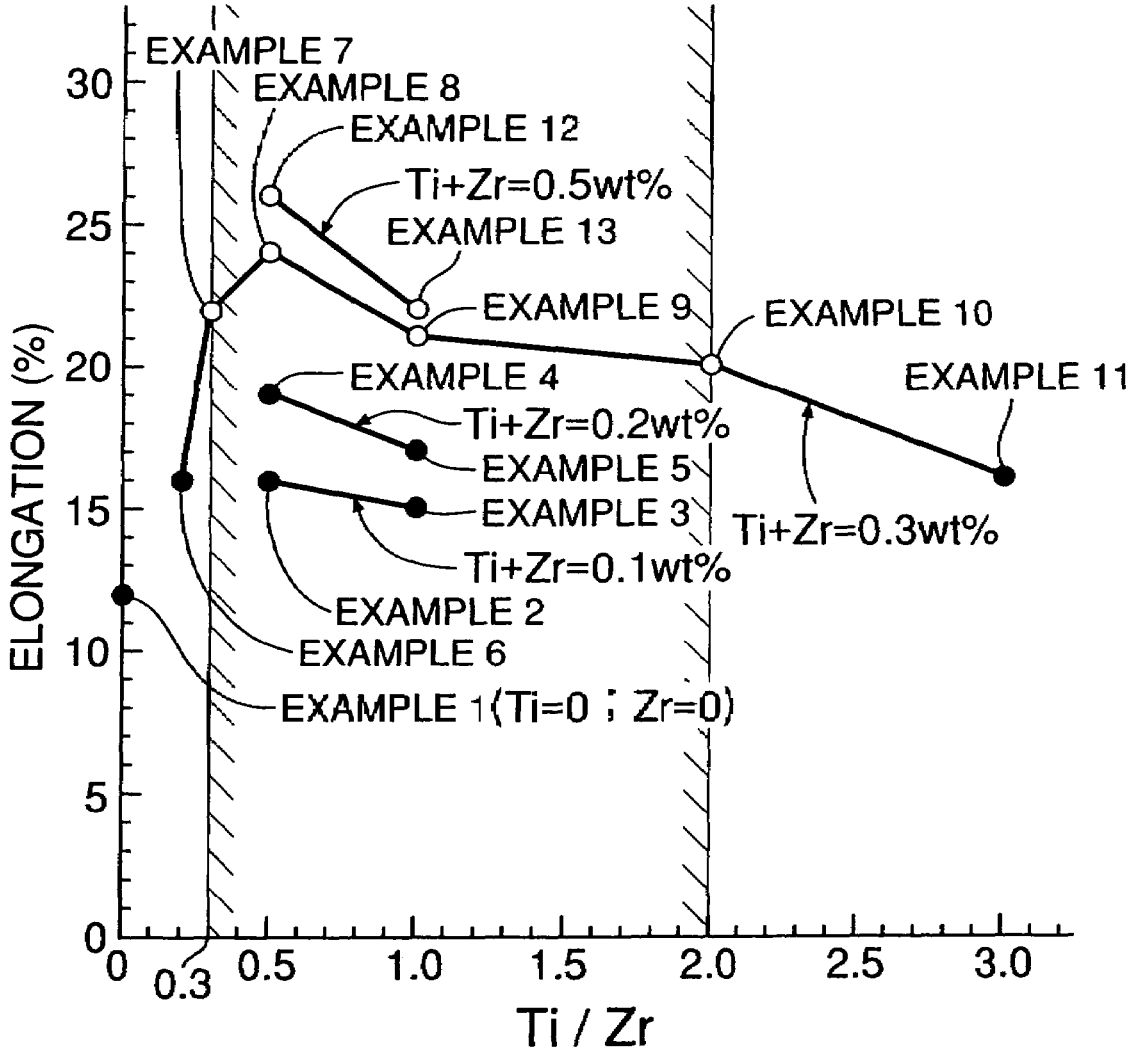
FIG. 1 is a graph showing the relationship between Ti/Zr and elongation.

FIG. 1 is a graph, based on Table 2, of the relationship between Ti/Zr and elongation, separated according to differences in Ti+Zr. As is clear from FIG. 1, in the die-cast products, by specifying the amounts of Mg, Mn, Si, and Fe added and setting the sum (Ti+Zr) of the amounts of Ti and Zr added to 0.3 wt % or greater and the ratio (Ti/Zr) of the amounts of Ti and Zr added to at least 0.3 but not more than 2, as in Examples 7 to 10, 12, and 13, it is possible to ensure high elongation, and thus excellent toughness.

The pouring temperature T of the Al—Mg casting alloy is desirably 720° C.≦T≦730° C., and the alloy is suitable as a casting material for a thin and large die-cast product having a minimum thickness $t_1$ of 1.2 mm≦$t_1$≦3 mm and a maximum flow distance d of the melt within the die cavity of 200 mm or greater.

Embodiment II

Figure 2:
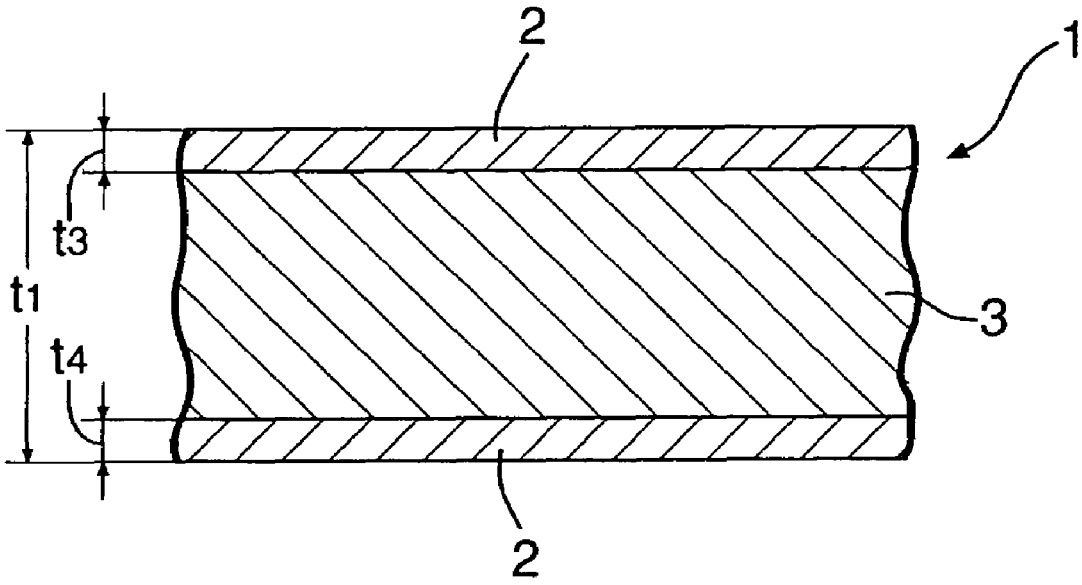
FIG. 2 is a sectional view of an essential part of a thin die-cast product.

In FIG. 2, a thin die-cast product 1 is a thin sheet having a minimum thickness $t_1$ of 1.2 mm≦$t_1$≦3 mm (average thickness $t_2$ of 1.5 mm≦$t_2$≦2 mm), and is cast using an Al—Mg alloy. The die-cast product 1 has a chill layer 2 on each of opposite faces, and a proportion P of a sum s of thicknesses $t_3$ and $t_4$ of the two chill layers 2 relative to the minimum thickness $t_1$, that is, $P=(s/t_1)\times 100$ (%), is set at 18% or greater. The die-cast product 1 has a large size, such that the maximum flow distance d of the melt within the die cavity is 200 mm or greater.

In accordance with this arrangement, the thin die-cast product 1 is formed from an Al—Mg alloy having excellent toughness, the cross-sectional structure thereof is a sandwich structure in which a relatively coarse metal structure as a main body 3 is sandwiched between the two chill layers 2 having a relatively thick and compact metal structure and, moreover, a lot of the impurities in the melt are captured in the two chill layers 2; it is therefore possible to increase the elongation δ of the thin die-cast product 1 having the thickness $t_1$ so that δ≧15%, thereby enabling high toughness to be achieved.

With regard to the Al—Mg alloy, one is used in which 3.5 wt %≦Mg≦4.5 wt %, 0.8 wt %≦Mn≦1.5 wt %, Si<0.5 wt %, Fe<0.5 wt %, and 0.1 wt %≦Ti and/or Zr≦0.3 wt %, with the balance being Al.

Although this Al—Mg alloy has excellent toughness, since its flowability is poor, it is not suitable for casting of the thin and large die-cast product 1. Therefore, when casting the thin and large die-cast product 1 using the Al—Mg alloy as a casting material, a vacuum die-casting method was employed, the temperatures of the die and the sleeve were set so as to be relatively high and, moreover, the time for filling the cavity with the melt was optimized.

Specific examples are explained below.

As one example of the Al—Mg alloy, one having 4 wt % of Mg, 0.9 wt % of Mn, 0.2 wt % of Si, 0.2 wt % of Fe, and 0.2 wt % of Ti, with the balance being Al was selected.

Casting was carried out using a melt having the above-mentioned alloy composition by placing a die in a vacuum die-casting machine in which the conditions were: vacuum level within cavity: 6 kPa, die temperature: in the range 150° C. to 300° C., ceramic heat-insulating sleeve temperature: in the range 150° C. to 300° C. (the same temperature as the die temperature), pouring temperature: 720° C., and low speed injection: 0.5 m/sec, while changing the time in which the cavity was filled with the melt by changing the high speed injection in the range of 2 to 6 m/sec (converted to gate speed: 30 to 70 m/sec), and a plurality of thin and large die-cast products having an overall thickness of 1.5 mm (this was also the minimum thickness $t_1$), and a maximum flow distance d of the melt within the die cavity of approximately 600 mm were produced. Test pieces were prepared using each of the die-cast products, and these test pieces were subjected to measurement of elongation δ and the proportion P of the sum s of the thicknesses $t_3$ and $t_4$ of the two chill layers 2 relative to the thickness $t_1$ (1.5 mm).

Table 3 shows the die temperature and the sleeve temperature, the filling time for the melt, the proportion P with respect to the thicknesses of the two chill layers, and the elongation δ for each of the die-cast products 1.

TABLE 3

| Die-cast product | Die/sleeve temperature (° C.) | Filling time (ms) | Proportion P with respect to thicknesses of two chill layers (%) | Elongation δ (%) |
|---|---|---|---|---|
| Example 14 | 150 | 20 | — | — |
| Example 15 | 150 | 15 | 12 | 12 |
| Example 16 | 150 | 12 | 16 | 12 |
| Example 17 | 150 | 10 | 25 | 17 |
| Example 18 | 150 | 8.5 | 39 | 21 |
| Example 19 | 200 | 20 | 8 | 6 |
| Example 20 | 200 | 15 | 16 | 11 |
| Example 21 | 200 | 12 | 18 | 15 |
| Example 22 | 200 | 10 | 48 | 20 |
| Example 23 | 200 | 8.5 | 55 | 22 |
| Example 24 | 250 | 20 | 5 | 11 |
| Example 25 | 250 | 15 | 22 | 19 |
| Example 26 | 250 | 12 | 43 | 18 |
| Example 27 | 250 | 10 | 51 | 19 |
| Example 28 | 250 | 8.5 | — | — |
| Example 29 | 300 | 20 | 21 | 17 |
| Example 30 | 300 | 15 | 25 | 18 |
| Example 31 | 300 | 12 | 34 | 20 |
| Example 32 | 300 | 10 | — | — |
| Example 33 | 300 | 8.5 | — | — |

In Table 3, soldering to the die occurred in Examples 14, 28, 32, and 33 of the die-cast products, and these products were therefore excluded from calculation of the proportion P and measurement of the elongation δ.

Figure 3:
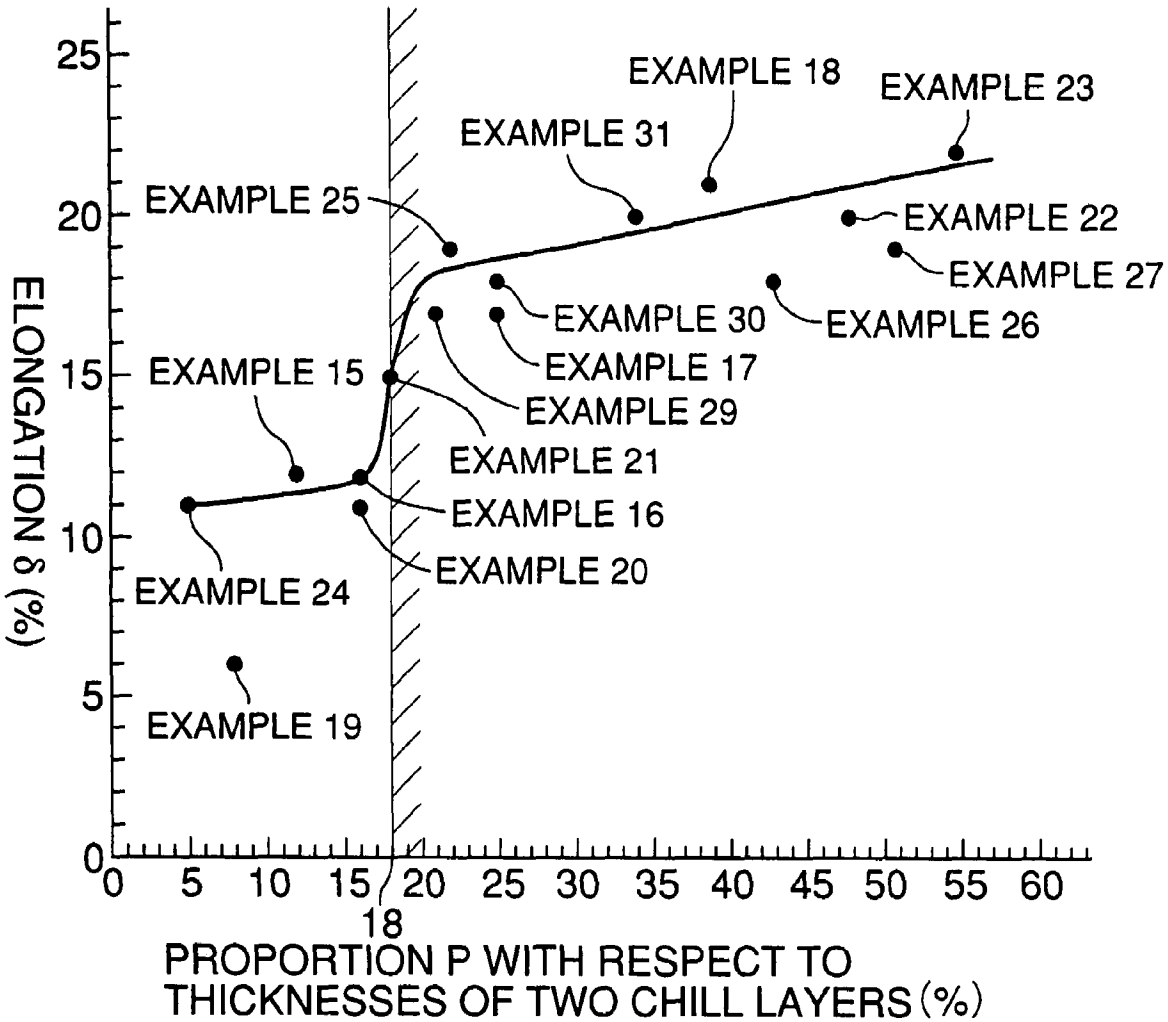
FIG. 3 is a graph showing the relationship between the elongation δ and a proportion P with respect to the thickness of the two chill layers.

FIG. 3 is a graph, based on Table 3, showing the relationship between the proportion P and the elongation δ for Examples 15 to 27 and 29 to 31. As is clear from Table 3 and FIG. 3, when the proportion P is set at 18% or greater, it is possible to ensure that the elongation δ is 15% or greater and thus improve the toughness of the thin die-cast product.

Figure 4:
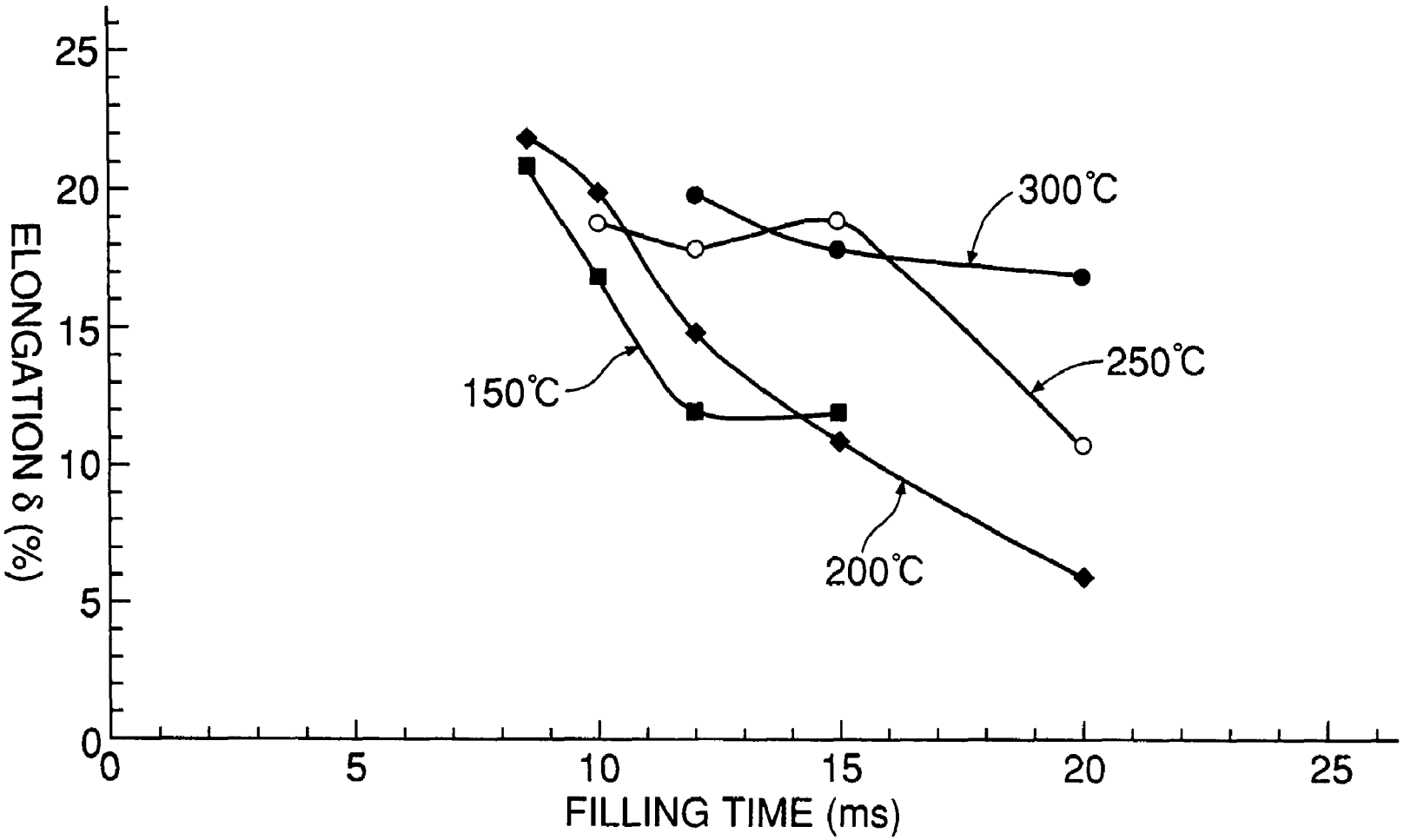
FIG. 4 is a graph showing the relationship between filling time and the elongation δ.

FIG. 4 is a graph, based on Table 3, showing the relationship between the filling time and the elongation δ for each die temperature, etc. It can be seen from FIG. 4 that in order to obtain a thin die-cast product having an elongation δ of 15% or greater, the die temperature, etc. and the filling time should be selected appropriately.

The invention claimed is:

1. A high toughness die-cast product, comprising:

an Al—Mg casting alloy, consisting of 3.5 wt %≦Mg≦4.5 wt %, 0.8 wt %≦Mn≦1.5 wt %, Si<0.5 wt %, Fe<0.5 wt %, wherein a sum (Ti+Zr) of the amounts of Ti and Zr added of equal to or greater than 0.3 wt %, and a ratio (Ti/Zr) of the amounts of Ti and Zr added of at least 0.3 but not more than 2, and balance being Al and unavoidable impurities.

2. A die-cast product, comprising:

an Al—Mg casting alloy consisting of 3.5 wt %≦Mg≦4.5 wt %

0.8 wt %≦Mn≦1.5 wt %,

Si<0.5 wt %,

Fe<0.5 wt %,

Ti>0.2 wt %, wherein a sum (Ti+Zr) of the amounts of Ti and Zr added of equal to or greater than 0.3 wt %, and a ratio (Ti/Zr) of the amounts of Ti and Zr added of at least 0.3 but not more than 2, and balance being Al and unavoidable impurities.

3. A die-cast product, comprising:

an Al—Mg casting alloy consisting of 3.5 wt %≦Mg≦4.5 wt %, 0.8 wt %≦Mn≦1.5 wt %, Si<0.5 wt %, Fe<0.5 wt %, Zr>0.3 wt %, wherein a sum (Ti+Zr) of the amounts of Ti and Zr added of greater than 0.3 wt %, and a ratio (Ti/Zr) of the amounts of Ti and Zr added of at least 0.3 but not more than 2, and balance being Al and unavoidable impurities.

* * * * *